US009550641B2

(12) United States Patent
Inoue

(10) Patent No.: US 9,550,641 B2
(45) Date of Patent: Jan. 24, 2017

(54) PAPER FEEDING DEVICE

(71) Applicant: RISO KAGAKU CORPORATION, Tokyo (JP)

(72) Inventor: Hideaki Inoue, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/940,711

(22) Filed: Nov. 13, 2015

(65) Prior Publication Data

US 2016/0152425 A1 Jun. 2, 2016

(30) Foreign Application Priority Data

Nov. 28, 2014 (JP) ..... 2014-240973

(51) Int. Cl.
*B65H 5/00* (2006.01)
*B65H 3/06* (2006.01)
(Continued)

(52) U.S. Cl.
CPC ..... *B65H 3/0669* (2013.01); *B41J 13/076* (2013.01); *B65H 3/06* (2013.01); *B65H 5/06* (2013.01); *B65H 5/062* (2013.01); *B65H 7/02* (2013.01); *B65H 7/18* (2013.01); *B65H 7/20* (2013.01); *B65H 2211/00* (2013.01); *B65H 2403/725* (2013.01); *B65H 2511/11* (2013.01); *B65H 2511/416* (2013.01); *B65H 2511/514* (2013.01); *B65H 2513/22* (2013.01); *B65H 2513/512* (2013.01); *B65H 2515/116* (2013.01); *B65H 2701/1311* (2013.01)

(58) Field of Classification Search
CPC ... B65H 3/0669; B65H 7/18; B65H 2403/725; B65H 2513/512; B65H 2211/00
See application file for complete search history.

(56) References Cited

U.S. PATENT DOCUMENTS 4,519,601 A 5/1985 Watanabe
8,006,976 B2 8/2011 Suzuki et al.
(Continued)

FOREIGN PATENT DOCUMENTS

JP 2009-40568 2/2009

OTHER PUBLICATIONS

Search Report issued by E.P.O. patent office in E.P.O. Patent Application No. 15194695.1, dated Apr. 28, 2016.

*Primary Examiner* — Howard Sanders
(74) *Attorney, Agent, or Firm* — Greenblum & Bernstein, P.L.C.

(57) ABSTRACT

A braking content determiner determines a content of braking control on a rotating operation such that rotation of a paper feeding motor stops within a time required for stopping from a time point of detection of a sheet by a sheet sensor to a time point of passing of a trailing edge of the sheet through a paper feeding roller, the time required for stopping being determined based on a length of the sheet in a sheet conveying direction, a predetermined speed of the paper feeding roller, and a distance between the paper feeding roller and the sheet sensor in a sheet conveying route. A controller performs the braking control on the rotating operation of the paper feeding motor, according to the content determined by the braking content determiner, upon or prior to the detection by the sheet sensor of the sheet sent out by the paper feeding roller.

15 Claims, 5 Drawing Sheets

(51) Int. Cl.

| | |
|---|---|
| ***B65H 5/06*** | (2006.01) |
| ***B65H 7/02*** | (2006.01) |
| ***B65H 7/18*** | (2006.01) |
| ***B41J 13/076*** | (2006.01) |
| ***B65H 7/20*** | (2006.01) |

(56) References Cited

U.S. PATENT DOCUMENTS

| | | | | |
|---|---|---|---|---|
| 8,141,871 | B2 * | 3/2012 | Nakazawa | B65H 7/02 271/256 |
| 9,216,876 | B2 | 12/2015 | Suzuki | |
| 2010/0289210 | A1 | 11/2010 | Nakazawa | |
| 2014/0163723 | A1 | 6/2014 | Geserich | |

* cited by examiner

PAPER FEEDING DEVICE

CROSS REFERENCE TO RELATED APPLICATION

This application is based upon and claims the benefit of priority from the prior Japanese Patent Application No. 2014-240973, filed on Nov. 28, 2014, the entire contents of which are incorporated herein by reference.

BACKGROUND

1. Technical Field

The disclosure relates to a paper feeding device configured to feed sheets.

2. Related Art

A printer such as an inkjet printer or a stencil printer includes a paper feeding device configured to send out sheets from a paper feed tray and convey the sheets to a printing unit. In such a paper feeding device, a paper feeding roller sends out each sheet one by one on the paper feed tray to an intermediate conveying roller, and the intermediate conveying roller sends out the sheet to a registration roller. A leading edge of the sent-out sheet abuts on the registration roller and temporarily stops.

The intermediate roller continues to send out the sheet toward the registration roller after the leading edge of the sheet stops. Accordingly, the sheet forms sag between the registration roller and the intermediate conveying roller until the registration roller starts to rotate. This sag corrects skewing of the sheet and the sheet whose skewing is corrected is sent out to the printing unit with the rotation start of the registration roller.

A motor driving the paper feeding roller is stopped by deceleration control after the leading edge of the sheet reaches the intermediate conveying roller. The motor is connected to the paper feeding roller via a one-way clutch, and the paper feeding roller is rotated by following the sheet after the motor stops. The following rotation of the paper feeding roller continues until a trailing edge of the sheet passes the paper feeding roller.

Stopping the motor for the paper feeding roller by the deceleration control requires a certain amount of time. Accordingly, when the trailing edge of the sheet passes the paper feeding roller before the motor stops, the paper feeding roller ends the following rotation, but continues to rotate for a while by the drive of the motor and sends out the subsequent sheet in the paper feed tray slightly. Due to this, the subsequent sheet is sent out from the paper feed tray sometimes at incorrect timing.

Japanese Unexamined Patent Application Publication 2009-40568 propose a technique of sending out a sheet to a printing unit at correct timing. In this technique, when a sensor arranged between a paper feeding roller and a registration roller detects a leading edge of the sheet, the speed of a conveying roller conveying the sheet is reduced from a first speed to a second speed. In this speed control, the second speed is set higher as the timing at which the sensor detects the leading edge of the sheet becomes later.

SUMMARY

If sheets vary in position in the paper feed tray, the timing of reaching the registration roller may vary among the sheets. The aforementioned technique of Japanese Unexamined Patent Application Publication No. 2009-40568 is very effective in eliminating such variation. However, this technique does not fundamentally eliminate variation in the leading edge position among the sheets sent out from the paper feed tray.

An object of the disclosure is to provide a paper feeding device capable of suppressing a position shift of a subsequent sheet in a paper feed tray in the process of stopping a paper feed motor rotating a paper feeding roller.

A paper feeding device in accordance with some embodiments includes: a paper feeding roller configured to rotate at a predetermined speed and send out sheets one by one from a paper feed tray on which the sheets are stacked to a sheet conveying route located downstream of the paper feed tray in a sheet conveying direction; a paper feeding motor configured to perform a rotating operation of rotating the paper feeding roller and maintain a rotational speed of the paper feeding roller at the predetermined speed; an intermediate conveying roller arranged downstream of the paper feeding roller in the sheet conveying direction in the sheet conveying route and configured to send out each of the sheets sent out by the paper feeding roller to a position located downstream of the intermediate conveying roller in the sheet conveying direction in the sheet conveying route; a sheet sensor configured to detect the sheet having a leading edge reaching the intermediate conveying roller; a braking content determiner configured to determine a content of braking control on the rotating operation such that rotation of the paper feeding motor stops within a time required for stopping from a time point of detection of the sheet by the sheet sensor to a time point of passing of a trailing edge of the sheet through the paper feeding roller, the time required for stopping being determined based on a length of the sheet in the sheet conveying direction, the predetermined speed, and a distance between the paper feeding roller and the sheet sensor in the sheet conveying route; and a controller configured to perform the braking control on the rotating operation of the paper feeding motor, according to the content determined by the braking content determiner, upon or prior to the detection by the sheet sensor of the sheet sent out by the paper feeding roller.

The configuration described above can suppress a position shift of a subsequent sheet in the paper feed tray in the process of stopping the paper feed motor rotating the paper feeding roller.

Specifically, since the sheet sent out from the paper feed tray to the sheet conveying route by the paper feeding roller can be conveyed by the intermediate conveying roller when the leading edge of the sheet reaches the intermediate conveying roller, the rotating operation of the paper feeding motor for rotating the paper feeding roller can be stopped at this point.

However, when the rotating operation is stopped, the paper feeding roller and the paper feeding motor rotate by inertia. Moreover, the paper feeding roller follows the sheet conveyed by the intermediate roller and is rotated by the sheet until the trailing edge of the sheet passes the paper feeding roller. Hence, when the rotation of the paper feeding motor by inertia stops before the trailing edge of the sheet passes the paper feeding roller, the paper feeding roller is not rotated by the paper feeding motor after the passing of the trailing edge of the sheet.

Thus, it is possible to set the time point at which the trailing edge of the sheet passes the paper feeding roller as target timing for stopping the rotation of the paper feeding motor by inertia and use a period from the detection of the sheet by the sheet sensor to this time point as an indication of time usable for stopping the rotating operation of the paper feeding motor. These time point and period can be used as time elements of the rotating operation of the paper feeding motor and the rotation of the paper feeding roller in the case of determining the content of the braking control on the rotating operation of the paper feeding motor.

Moreover, the length of the sheet in the sheet conveying direction, the predetermined speed which is the rotational speed of the paper feeding roller in the sending out of the sheet, and the distance between the paper feeding roller and the sheet sensor are all known and can be used as distance elements of relative positions of the paper feeding roller and the sheet in the case of determining the content of the braking control on the rotating operation of the paper feeding motor.

The content of braking control performed on the rotating operation of the paper feeding motor such that the rotation of the paper feeding motor by inertia stops in accordance with the timing of the trailing edge of the sheet passing the paper feeding roller can be determined based on the time elements of the rotating operation of the paper feeding motor and the rotation of the paper feeding roller and the distance elements of the relative positions of the paper feeding roller and the sheet which are obtained as described above.

Thus, in the process of stopping of the paper feeding motor rotating the paper feeding roller, it is possible to suppress the situation where the paper feeding motor continues to rotate after the passing of the trailing edge of the sent-out sheet and where the paper feeding roller sends out the subsequent sheet in the paper feed tray by the time the paper feeding motor stops. This can suppress the position shift of the subsequent sheet.

The braking content determiner may determine deceleration control on the rotating operation of the paper feeding motor at a degree of deceleration as the content of the braking control.

The configuration described above can brake the paper feeding motor to stop the paper feeding motor in accordance with the timing of the trailing edge of the sheet passing the paper feeding roller, by using the braking control according to the determined content.

The braking content determiner may determine that the content of the braking control includes a start timing of deceleration control on the rotating operation of the paper feeding motor at a degree of deceleration due to inertia.

The configuration described above can brake the paper feeding motor to stop the paper feeding motor in accordance with the timing of the trailing edge of the sheet passing the paper feeding roller, by using the braking control according to the determined content.

The braking content determiner may determine the content of the braking control from inertia of the paper feeding roller depending on a paper type of the sheet.

When sheets different in paper type are sent out from the paper feed tray, the configuration described above can brake the paper feeding motor to stop the paper feeding motor in accordance with the timing of the trailing edge of the sheet passing the paper feeding roller, by performing the braking control according to the content corresponding to the paper type of each sheet.

The braking content determiner may determine a time point of the detection of the sheet by the sheet sensor as a start timing of the deceleration control.

The braking content determiner may determine a time point prior to the detection of the sheet by the sheet sensor as the start timing of the deceleration control.

The braking content determiner may determine that the content of the braking control includes deceleration control on the rotating operation of the paper feeding motor at a degree of deceleration and a start timing of the deceleration control. the paper feeding motor is connected to the paper feeding roller via a one-way clutch.

DETAILED DESCRIPTION

Figure 1:
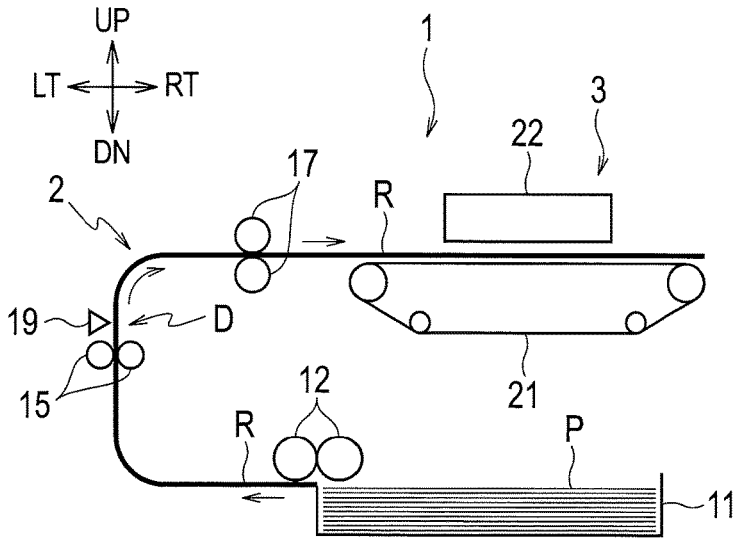
FIG. 1 is an explanatory diagram illustrating a schematic configuration of a printer including a paper feeding device in an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
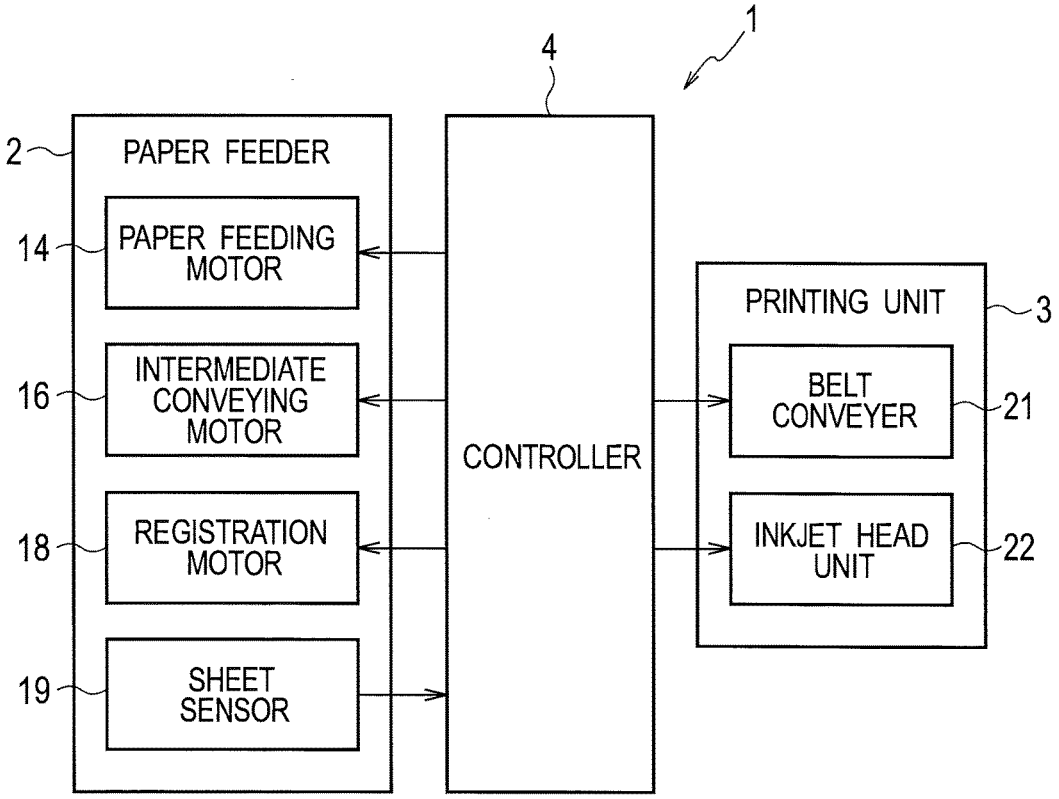
FIG. 2 is a block diagram illustrating a configuration of a control system of the printer illustrated in FIG. 1.

FIG. 1 is an explanatory diagram illustrating a schematic configuration of a printer including a paper feeding device in one embodiment of the present invention. FIG. 2 is a block diagram illustrating a configuration of a control system of the printer illustrated in FIG. 1. In the following description, directions orthogonal to the sheet surface of FIG. 1 are referred to as front-rear directions, and a direction toward the front side of the sheet is referred to as front. In FIG. 1, directions of right, left, up, and down are denoted by RT, LT, UP, and DN, respectively. Moreover, a route illustrated by a bold line in FIG. 1 is a sheet conveying route R through which sheets P being print media are conveyed. In the following description, upstream and downstream mean upstream and downstream in the sheet conveying route R.

As illustrated in FIG. 1, the printer 1 includes a paper feeder 2 and a printing unit 3. Moreover, as illustrated in FIG. 2, the printer 1 further includes a controller 4 configured to control operations of the paper feeder 2 and the printing unit 3. Note that the paper feeding device of the embodiment includes the controller 4 used in common with the printer 1 and the paper feeder 2 of the printer 1.

The paper feeder 2 feeds the sheets P to the printing unit 3. As illustrated in FIG. 1, the paper feeder 2 includes a paper feed tray 11, paper feeding rollers 12, intermediate conveying rollers 15, registration rollers 17, and a sheet sensor 19. Moreover, as illustrated in FIG. 2, the paper feeder 2 further includes a paper feeding motor 14, an intermediate conveying motor 16, and a registration motor 18.

Figure 3:
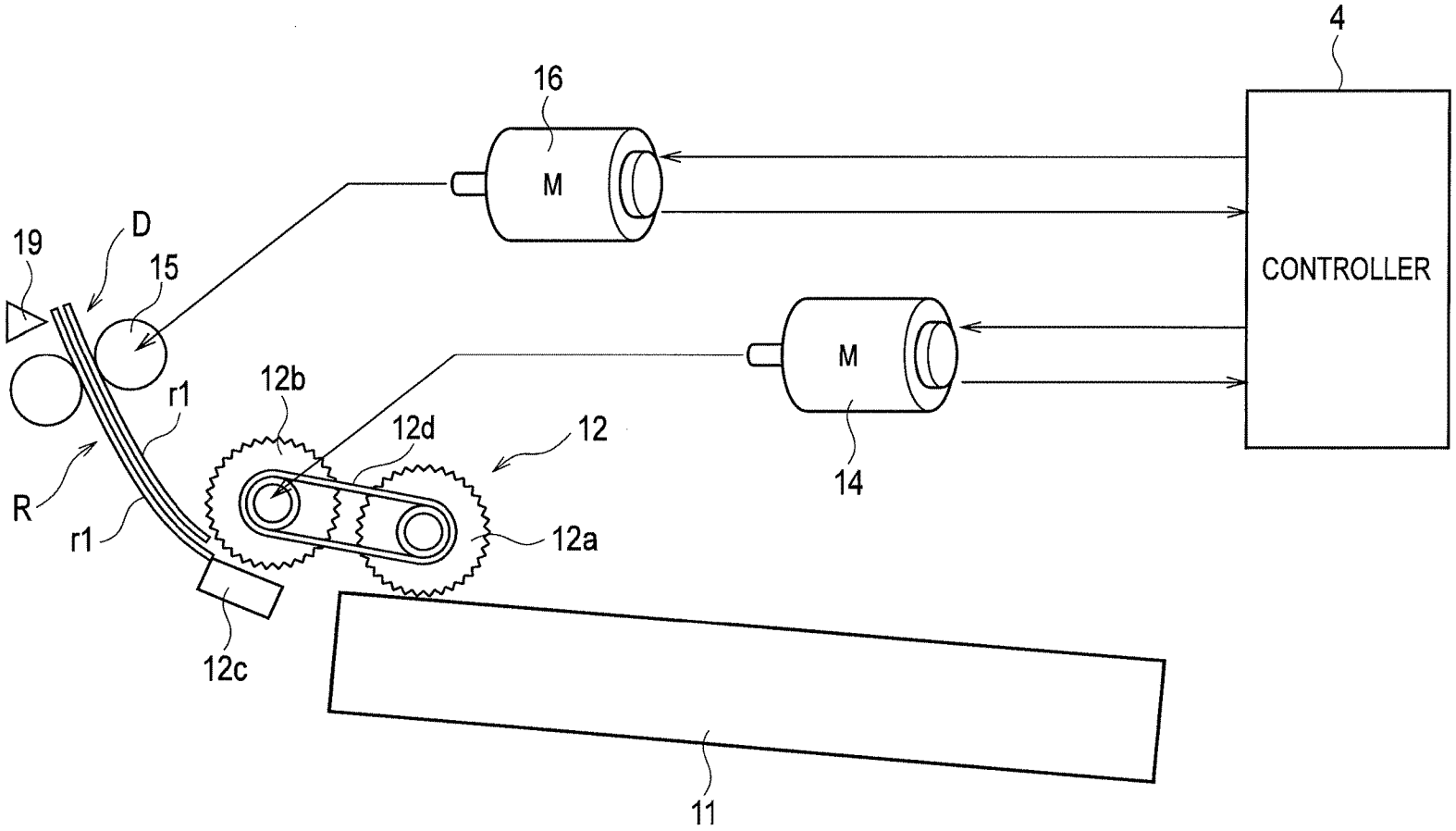
FIG. 3 is an explanatory diagram illustrating a schematic configuration of paper feeding rollers illustrated in FIG. 1.

The paper feed tray 11 illustrated in FIG. 1 is a tray on which the sheets P used for printing are stacked, and the paper feeding rollers 12 are arranged above the paper feed tray 11. FIG. 3 is an explanatory diagram illustrating a schematic configuration of the paper feeding rollers 12.

As illustrated in FIG. 3, the paper feeding rollers 12 include a scraper roller 12*a* and a pickup roller 12*b*. The scraper roller 12*a* is in contact with the top sheet P out of the sheets P stacked on the paper feed tray 11 and sends out the top sheet P from the paper feed tray 11 by being rotated. The pickup roller 12*b* picks up each sheet P, sent out from the paper feed tray 11 by the scraper roller 12*a*, one by one together with a friction pad 12*c* and sends out the sheet P to a space between a pair of sheet conveying guides r1 in the sheet conveying route R.

The paper feeding motor 14 rotates the paper feeding rollers 12. Specifically, the paper feeding motor 14 synchronously rotates the scraper roller 12*a* and the pickup roller 12*b* having shafts around which a timing belt 12*b* is wound. The paper feeding motor 14 is connected to the scraper roller 12*a* and the pickup roller 12*b* via a not-illustrated one-way clutch. This one-way clutch transmits only the rotation in a direction in which the sheet P is sent out toward the sheet conveying route R, from the paper feeding motor 14 to the scraper roller 12*a* and the pickup roller 12*b*

The pair of intermediate conveying rollers 15 are arranged downstream of the pickup roller 12*b* along the sheet conveying guides r1 of the sheet conveying route R. The intermediate conveying rollers 15 nip a leading edge of the sheet P being sent out from the paper feed tray 11 to the sheet conveying route R by the paper feeding rollers 12 (scraper roller 12*a* and pickup roller 12*b*), and send out the sheet P to the registration rollers 17 downstream in the sheet conveying route R. The intermediate conveying motor 16 drives one of the intermediate conveying rollers 15.

In the embodiment, in order to facilitate the description, description is given of a case where the paper feeder 2 has one paper feed tray 11 and, in accordance with this, is provided with one set of paper feeding rollers 12 and one set of intermediate conveying rollers 15 as illustrated in FIG. 1. However, the present invention can be applied to a case where multiple sets of paper feeding trays 11, paper feeding rollers 12, and intermediate conveying rollers 15 are provided.

The registration rollers 17 are arranged downstream of the intermediate conveying rollers 15. The registration rollers 17 temporarily stop the sheet P conveyed by the intermediate conveying rollers 15 and convey the sheet P to the printing unit 3 after sag is formed in the sheet P. The registration motor 18 drives the registration rollers 17.

The sheet sensor 19 detects the sheet P at a detecting position D downstream of the intermediate conveying rollers 15 and outputs a detection signal to the controller 4. The sheet sensor 19 is formed of an optical sensor having a light emitting element and a light receiving element.

The printing unit 3 prints the fed sheet P while conveying the sheet P. The printing unit 3 is arranged downstream of the paper feeder 2. The printing unit 3 includes a belt conveyor 21 and an inkjet head unit 22.

The belt conveyor 21 conveys the sheet P conveyed by the registration rollers 17 while sucking and holding the sheet P on a belt. Rollers around which the belt of the belt conveyor 21 is wound are driven by a not-illustrate motor. This causes the belt to rotate and the sheet P on the belt is conveyed.

The inkjet head unit 22 is arranged above the belt conveyor 21. The inkjet head unit 22 has multiple line-type inkjet heads in each of which multiple nozzles are arranged in a direction substantially orthogonal to the conveying direction of the sheet P (front-rear directions). The inkjet head unit 22 prints an image by ejecting inks from the inkjet heads onto the sheet P conveyed by the belt conveyor 21.

The controller 4 controls operations of the units in the printer 1. The controller 4 includes a CPU, a RAM, a ROM, a hard disk drive, and the like.

Specifically, the controller 4 performs control such that the paper feeder 2 feeds the sheet P to the printing unit 3 and, in the printing unit 3, the inkjet head unit 22 prints the sheet P by ejecting inks while the sheet P is conveyed by the belt conveyor 21.

In the operation of paper feeding to the registration rollers 17 by the intermediate conveying rollers 15 of the paper feeder 2, the controller 4 stops the intermediate conveying rollers 15 when the sheet P conveyed by the intermediate conveying rollers 15 abuts on the registration rollers 17 and sag of a specified amount L is formed in the sheet P. After stopping the intermediate conveying rollers 15, the controller 4 starts the drive of the registration rollers 17.

Moreover, the controller 4 controls the drive of the paper feeding motor 14, based on the detection of the sheet P by the sheet sensor 19.

Figure 4:
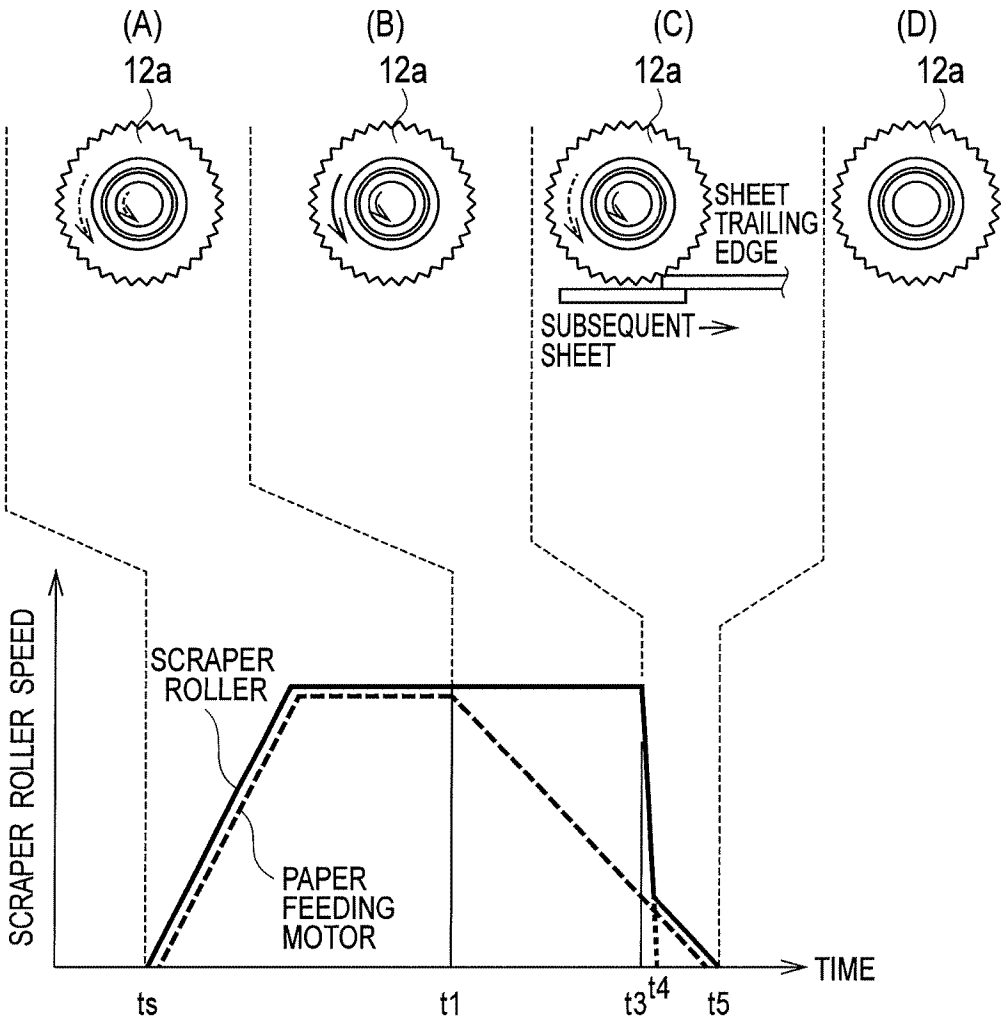
FIG. 4 is an explanatory diagram illustrating an overview of drive control of a paper feeding motor which is performed by a controller illustrated in FIG. 2.

FIG. 4 is an explanatory diagram illustrating an overview of the drive control of the paper feeding motor 14 which the controller 4 can perform. With generation of a print job or the like, the controller 4 causes the paper feeder 2 to feed the sheet P from the paper feed tray 11 to the printing unit 3. In this case, the controller 4 first drives the paper feeding motor 14 to rotate the paper feeding rollers 12 (scraper roller 12*a* and pickup roller 12*b*) in the direction in which the sheet P is sent out from the paper feed tray 11. In FIG. 4, a section from timing ts to timing t1 is referred to as section (A), a section from the timing t1 to timing t3 is referred to as section (B), a section from the timing t3 to timing t5 is referred to as section (C), and a section after the timing t5 is referred to as section (D). Note that FIG. 4 is provided to facilitate the understanding of braking control of the paper feeding motor 14 in the embodiment described below and does not explain the braking control of the paper feeding motor 14 in the embodiment.

In this case, the drive of the paper feeding motor 14 starts at the timing ts, and the paper feeding motor 14 is made to accelerate until the rotational speed of the paper feeding rollers 12 (scraper roller 12*a* and pickup roller 12*b*) reaches a predetermined speed corresponding to a conveying speed of the sheet P. In the section (A) of FIG. 4 before the timing t1 of start of deceleration control (drive off) for stopping the paper feeding motor 14, the paper feeding rollers 12 are driven and rotated by the paper feeding motor 14.

The leading edge of the sheet P sent out by the paper feeding rollers 12 reaches the intermediate conveying rollers 15 and is nipped while the control of the section (A) is performed. At this time point, the controller 4 drives the intermediate conveying motor 16 such that the intermediate conveying rollers 15 convey the sheet P at the same conveying speed as that of the paper feeding rollers 12. Accordingly, the sheet P nipped by the intermediate conveying rollers 15 and being sent out by the paper feeding rollers 12 is conveyed toward the registration rollers 17 by the intermediate conveying rollers 15 at the same speed.

When the sheet P is nipped by the intermediate conveying rollers 15, there is no need to send out the sheet P with the paper feeding rollers 12 (scraper roller 12*a* and pickup roller 12*b*). Accordingly, the controller 4 starts the deceleration control for stopping the rotation of the paper feeding motor 14 at, for example, the timing t1 of the sheet sensor 19 detecting the leading edge of the sheet P passing the intermediate conveying rollers 15. The deceleration control of the paper feeding motor 14 is performed by reducing the speed of the rotation of the paper feeding motor 14 at a predetermined degree of deceleration (for example, a degree of deceleration due to inertia).

After the timing t1 of start of the deceleration control of the paper feeding motor 14, in the section (B) of FIG. 4 before the stopping of the paper feeding motor 14, the paper feeding rollers 12 (scraper roller 12*a* and pickup roller 12*b*) follow the sheet P conveyed toward the registration rollers 17 by the intermediate conveying rollers 15, and are rotated at the same speed as in the section (A).

This following rotation continues until the timing t3 of the trailing edge of the sheet P passing the pickup roller 12*b* out of the paper feeding rollers 12. After the timing t3, the rotation of the paper feeding rollers 12 (scraper roller 12*a* and pickup roller 12*b*) stops due to load applied to the paper feeding rollers 12.

Along with this, the rotational speed of the paper feeding motor 14 gradually decreases after the timing t1 due to the deceleration control by the controller 4, and the paper feeding motor 14 eventually stops. However, when the predetermined degree of deceleration in the deceleration control is too small, the time required until the paper feeding motor 14 stops is long and, as illustrated in the section (C) of FIG. 4, the rotation the paper feeding motor 14 stops long after the timing t3 of the trailing edge of the sheet P passing the pickup roller 12*b*.

When the rotation the paper feeding motor 14 stops long after the timing t3 of the trailing edge of the sheet P passing the pickup roller 12*b*, the rotation of the paper feeding motor 14 by inertia does not stop by the timing t4 at which the rotation of the paper feeding rollers 12 by inertia should stop after the passing of the sheet P.

The paper feeding rollers 12 (scraper roller 12*a* and pickup roller 12*b*) are thus rotated by the paper feeding motor 14 until the rotation of the paper feeding motor 14 stops, after the timing t4 at which the rotation of the paper feeding rollers 12 by inertia should stop after the trailing edge of the sheet P passes the pickup roller 12*b* of the paper feeding rollers 12. Then, after the timing t5 of stop of the rotation of the paper feeding motor 14, i.e. in the section (D) of FIG. 4, the rotation of the paper feeding rollers 12 stops at last.

In this case, the subsequent sheet P in the paper feed tray 11 is sent out by the rotation of the paper feeding rollers 12 (scraper roller 12*a* and pickup roller 12*b*) in the section (C) in which the paper feeding motor 14 under the deceleration control rotates the paper feeding rollers 12 by inertia, after the timing t4 at which the rotation of the paper feeding rollers 12 by inertia should stop after the trailing edge of the sheet P sent out from the paper feed tray 11 passes the pickup roller 12*b*.

Figure 5:
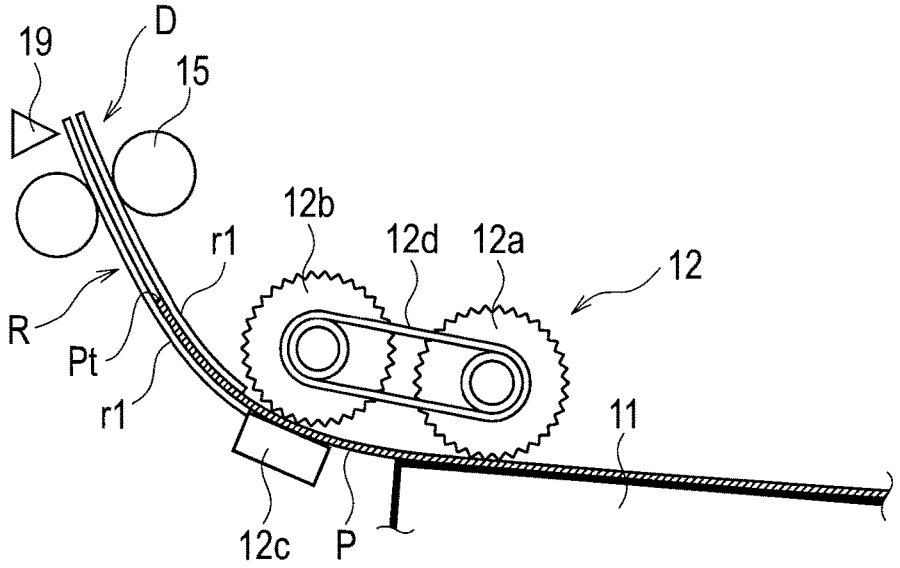
FIG. 5 is an explanatory diagram illustrating a state where a subsequent sheet is sent out by a paper feeding roller which occurs when rotation stop of the paper feeding motor in FIG. 3 is late.

In a period from the timing t4 at which the rotation of the paper feeding rollers 12 by inertia should stop to the timing t5 of stop of the paper feeding motor 14 and stop of the rotation paper feeding rollers 12, as illustrated in the explanatory diagram of FIG. 5, the subsequent sheet P is sent out from the paper feed tray 11 to the space between the sheet conveying guides r1 of the sheet conveying route R by the paper feeding rollers 12 (scraper roller 12*a* and pickup roller 12*b*). The position of the leading edge Pt of the subsequent sheet P is thereby shifted from an original position in the paper feed tray 11 toward the intermediate conveying rollers 15.

Specifically, the paper feeding motor 14 rotates at a rotational speed Vj by inertia in a period from the timing t3 of the trailing edge of the sheet P passing the pickup roller 12*b* to the timing t5 of stop of the rotation of the paper feeding motor 14 by inertia and stop of the rotation of the paper feeding rollers 12 (scraper roller 12*a* and the pickup roller 12*b*) due to the rotation of the paper feeding motor 14.

A send-out amount dj of the sheet P by the paper feeding rollers 12 in this period (t5−t3) is expressed by the following formula, $$dj=\{[(Vj/2\pi)/R]\times(\phi\times\pi)\times(t5-t3)\}/2$$

where ϕ is the diameter of the scraper roller 12*a* and R is the reduction ratio in a not-illustrated power transmission system existing between the paper feeding motor 14 and the scraper roller 12*a*.

Note that description is given assuming that the reduction ratio R is "1" and the paper feeding motor 14 and the paper feeding rollers 12 rotate at the same speed in all of the described portions and portions to be described below in the embodiment, in order to facilitate the description.

When the subsequent sheet P in the paper feed tray 11 is fed to the printing unit 3 by the paper feeder 2 in this state, the position of the leading edge Pt of the subsequent sheet P is shifted toward the intermediate conveying rollers 15 by the send-out amount dj, and the timing of the leading edge Pt of the subsequent sheet P reaching the registration rollers 17 is earlier by the time corresponding to this shift. Then, the timing of sending out the subsequent sheet P from the registration rollers 17 to the printing unit 3 also becomes earlier. When the timing of sending out the subsequent sheet P to the printing unit 3 is earlier, the timing of forming an image on the subsequent sheet P in the printing unit 3 also is earlier and the position of the image relative to the subsequent sheet P is shifted.

Moreover, when the first sheet P is sent out by the paper feeding rollers 12 from a correct position in the paper feed tray 11 and the subsequent sheet P is sent out by the paper feeding rollers 12 from a position slightly sent out from the paper feed tray 11, a sheet interval between the first sheet P sent out to the printing unit 3 at correct timing and the subsequent sheet P sent out to the printing unit 3 at timing earlier than the correct timing is shorter than a normal sheet interval. Then, collision between the sheets P and jam due to this collision may occur.

In view of this, in the paper feeding device of the embodiment, the controller 4 performs the deceleration control of the paper feeding motor 14 (braking control on the rotating operation of the paper feeding motor 14) such that the rotation of the paper feeding motor 14 stops before the rotation of the paper feeding rollers 12 following the sheet P stops with the passing of the sheet P.

The deceleration control of the paper feeding motor 14 performed by the controller 4 includes two general patterns (content of the braking control on the rotating operation of the paper feeding motor 14 which stops the rotation of the paper feeding motor 14 before the trailing edge of the sheet P passes the paper feeding rollers 12). The first pattern is a pattern of changing the degree of deceleration of the paper feeding motor 14 from that in the deceleration control pattern of the example described above, without changing the start timing of the deceleration control. The second pattern is a pattern of changing the start timing of deceleration control from that in the deceleration control pattern of the example described above, without changing the degree of deceleration of the paper feeding motor 14. The deceleration control in each of the patterns is described below with reference to the explanatory diagram of FIG. 6. Note that the controller 4 functions as a braking content determiner configured to determine the content of the braking control, and performs the braking control according to the determined content. In the embodiment, the determination of the content of the braking control and the braking control according to the determined content are performed by the controller 4. However, it is possible to additionally provide a braking content determiner separate from the controller 4 which includes a CPU, a RAM, a ROM and the like, and determine the content of the braking control in the braking content determiner.

In the first pattern, the controller 4 first starts the deceleration control of the paper feeding motor 14 at the timing t1 of the sheet sensor 19 detecting the leading edge of the sheet P passing the intermediate conveying rollers 15. In this case, the degree of deceleration of the paper feeding motor 14 is changed to a degree of deceleration (1) which is greater than the degree of deceleration in the example described above.

Specifically, assume a case where the deceleration control of the paper feeding motor 14 is performed at the predetermined degree of deceleration in the example described above, starting from the timing t1 of the sheet sensor 19 detecting the leading edge of the sheet P passing the intermediate conveying rollers 15. In this case, the rotation of the paper feeding motor 14 stops at the timing t5 which is later than the timing t4 at which the rotation of the paper feeding rollers 12 by inertia after the passing of the trailing edge of the sheet P sent out from the paper feed tray 11 should stop.

In view of this, in the first pattern, a time t required for stopping (1), which is from the start of the deceleration control to the timing t3 of the trailing edge of the sheet P passing the pickup roller 12*b*, is made shorter than the time (=t5−t1) required to stop the rotation of the paper feeding motor 14 from the start of the deceleration control of the paper feeding motor 14 at the predetermined degree of deceleration in the example described above.

Moreover, the rotation of the paper feeding motor 14 is stopped by the timing t3 of the trailing edge of the sheet P passing the pickup roller 12*b*. The paper feeding motor 14 thereby stops by the timing t4 of stop of the rotation of the paper feeding rollers 12 by inertia, the paper feeding rollers 12 no longer being rotated by the sheet P due to passing of the sheet P.

Figure 6:
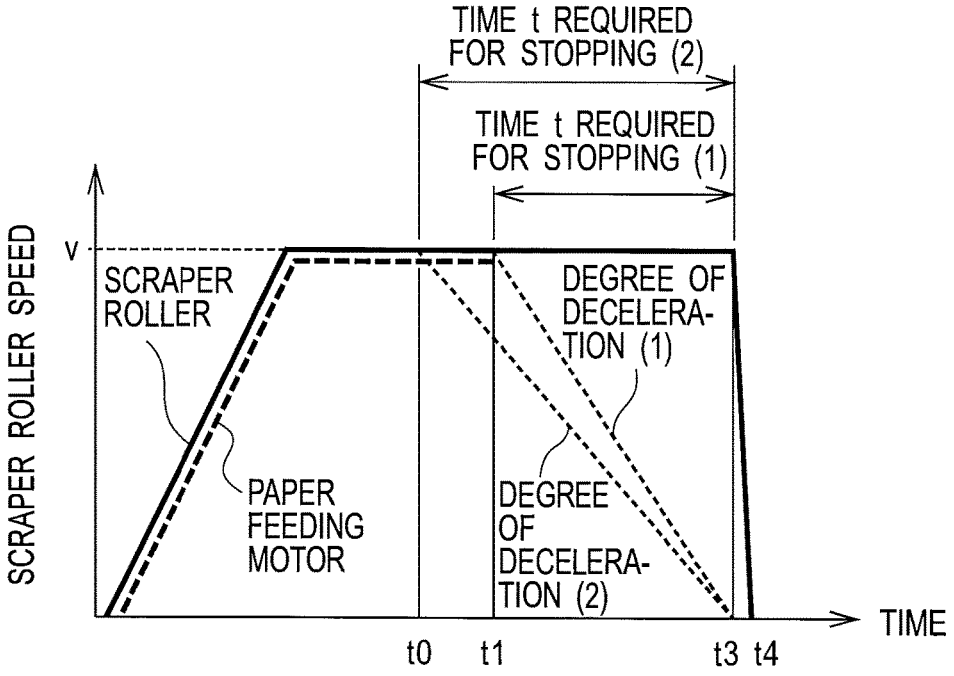
FIG. 6 is an explanatory diagram illustrating an overview of deceleration control of the paper feeding motor performed by the controller illustrated in FIG. 2.
Figure 7:
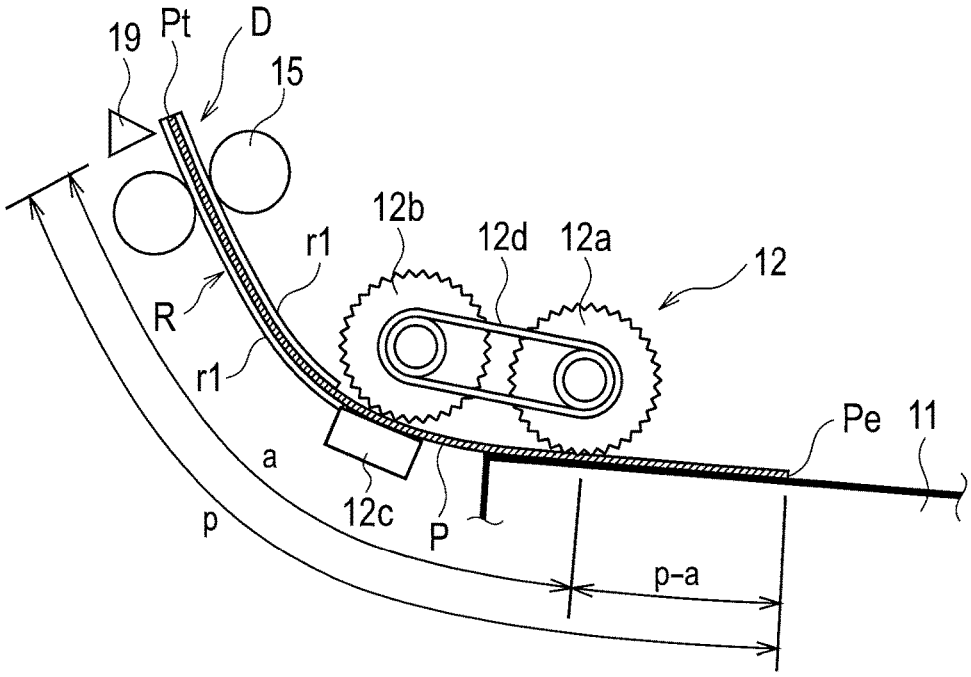
FIG. 7 is an explanatory diagram illustrating a way of determining a degree of deceleration in the deceleration control of the paper feeding motor performed by the controller illustrated in FIG. 2.
Figure 8:
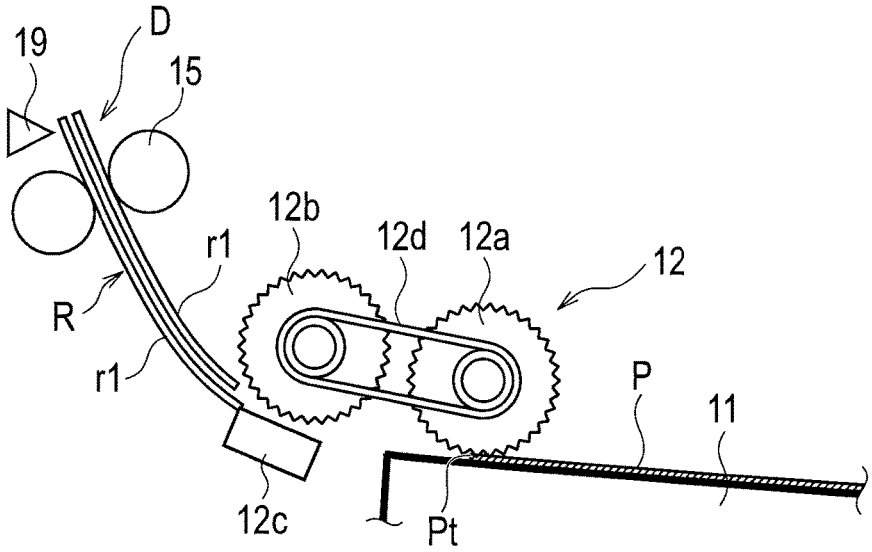
FIG. 8 is an explanatory diagram illustrating a state where the sheet is sent out by the paper feeding rollers when the controller illustrated in FIG. 2 performs the deceleration control of the paper feeding motor.

As illustrated in the explanatory diagram of FIG. 7, the degree of deceleration (1) can be obtained by dividing a conveying speedy (predetermined speed) (a speed in a horizontal section of a graph of the scraper roller speed in FIG. 6) of the sheet P at the time when the rotational speed of the scraper roller 12*a*, the pickup roller 12*b*, and the intermediate conveying rollers 15 becomes constant after the start of rotation and acceleration, by the time t required for stopping (1) in the deceleration control at the degree of deceleration (1).

Moreover, the time t required for stopping (1) can be obtained by dividing the difference (p−a) between the total length of the sheet P and the distance a from the scraper roller 12*a* to the detecting position D where the sheet sensor 19 is installed, by the conveying speed v of the sheet P.

In the case where failures such as shifting of the printing position of the image relative to the sheet P, collision between the sheets P, and occurrence of jam do not occur when the degree of position shifting of the sheet P from the normal position before the send-out from the paper feed tray 11 by the paper feeding rollers 12 is small, the time t required for stopping (1) may be obtained in consideration of this.

For example, the rotation of the paper feeding motor 14 is stopped before the send-out amount dj of the sheet P in the period (t5−t3) from the time point when the sheet P passes the pickup roller 12*b* to the time point when the rotation of the paper feeding motor 14 by inertia stops reaches a distance x which is the maximum value of the allowable range for the position shift of the sheet P from the normal position.

The aforementioned distance x is reflected in a formula for obtaining the time t required for stopping (1). In this case, the time t required for stopping (1) is obtained by setting a term of a numerator in this formula to (p−a+x) and dividing this term by the conveying speed v of the sheet P.

The degree of deceleration (1) needs to be set within a range of a braking torque Q which can be applied to the paper feeding motor 14. The braking torque Q of the paper feeding motor 14 can be obtained by multiplying the inertia J of the paper feeding rollers 12 (scraper roller 12*a* and pickup roller 12*b*) by the degree of deceleration (1). Accordingly, the value of the degree of deceleration (1) is set such that a value Q1 of the thus-obtained braking torque Q falls within the allowable range.

Meanwhile, in the second pattern, the controller 4 does not change the degree of deceleration of the paper feeding motor 14 from a degree of deceleration (2) which is the same as the degree of deceleration in the example described above. Instead, the controller 4 changes the start timing of the deceleration control to timing t0 which is earlier than the timing t1 of the sheet sensor 19 detecting the leading edge of the sheet P passing the intermediate conveying rollers 15.

Although a time t required for stopping (2) from the start of the deceleration control to the stop of the paper feeding motor 14 is the same as that in the example described above, this change causes the paper feeding motor 14 to stop by the timing t4 of stop of the paper feeding rollers 12 no longer rotated by the sheet P due to passing of the sheet P.

In this case, the timing t0 may be timing at which the leading edge of the sheet P reaches or has already reached the intermediate conveying rollers 15 or timing at which the leading edge of the sheet P has not reached the intermediate conveying rollers 15 yet. Note that the latter timing is such timing that the leading edge of the sheet P can reach the intermediate conveying rollers 15 by the rotation of the paper feeding motor 14 and the paper feeding rollers 12 by inertia after the start of the deceleration control, before the rotation of the paper feeding rollers 12 stops.

The time t required for stopping (2) can be obtained by dividing the conveying speed v (scraper roller speed) of the sheet P by the intermediate conveying rollers 15, by the degree of deceleration (2). Moreover, a distance L by which the sheet P is conveyed in the deceleration control at the degree of deceleration (2) in the time t required for stopping (2) can be obtained by multiplying the degree of deceleration (2) by the square of the time t required for stopping (2).

The start timing t0 of the deceleration control is thus timing at which the trailing edge Pe of the sheet P is located behind (on the paper feed tray 11 side of) the scraper roller 12*a* by the distance L. The leading edge Pt of the sheet P at this timing is located behind (on the paper feed tray 11 side of) the detecting position D of the sheet sensor 19 by a distance equal to the difference (L−(p−a)) between the distance L and the difference (p−a) between the total length p of the sheet P and the distance a from the scraper roller 12*a* to the detecting position D where the sheet sensor 19 is installed. In other words, this position can be defined based on the total length p of the sheet P and the distance a from the scraper roller 12*a* to the detecting position D where the sheet sensor 19 is installed.

In summary, the degree of deceleration (1) which is determined in the first pattern and the time t required for stopping (2) and the start timing t0 of the deceleration control based thereon which are determined in the second pattern (2) can be determined based on the total length p of the sheet P and the distance a from the scraper roller 12*a* to the detecting position D where the sheet sensor 19 is installed.

Note that a rotation torque Qj of the paper feeding rollers 12 rotated by the paper feeding motor 14 rotating by inertia after the start of the deceleration control is equal to a value obtained by multiplying a degree of deceleration αj of the paper feeding motor 14 at this time by the inertia J of the paper feeding rollers 12. When the rotation torque Qj is equal to or greater than a friction force To acting between the sheet P and the paper feeding rollers 12, the sheet P is sent out by the paper feeding rollers 12 rotated by the paper feeding motor 14 rotating by inertia.

The degree of deceleration αj of the paper feeding motor 14 rotating by inertia can be expressed by Vj/(t5−t3), where the rotational speed Vj of the paper feeding motor 14 by inertia is divided by the period (t5−t3) of rotation of the paper feeding motor 14 by inertia.

The friction force To acting between the paper feeding rollers 12 and the sheet P varies depending on the paper type (for example, normal paper, mat paper, and the like). This is because the coefficient of friction of the sheet P varies depending on the paper type. Accordingly, there is a case where the sheet P of paper type with a small coefficient of friction is sent out from the paper feed tray 11 but the sheet P of paper type with a large coefficient of friction is not sent out from the paper feed tray 11 when the paper feeding rollers 12 rotate at the same rotation torque Q1.

In view of this, the controller 4 may check whether the friction force To acting between the paper feeding rollers 12 and the sheet P is less than the rotation torque Qj of the paper feeding rollers 12, by using information on the paper type of the sheets P stacked on the paper feed tray 11.

In this case, when the friction force To is equal to or lower than the rotation torque Q1, the controller 4 determines the degree of deceleration (1) of the paper feeding motor 14 in the first pattern or determines the time t required for stopping (2) and the start timing t0 of the deceleration control based thereon in the second pattern, and performs the deceleration control of the paper feeding motor 14 according to the determined content.

As described above, in the paper feeding device of the embodiment, the controller 4 performs the deceleration control of stopping the paper feeding motor 14, by using the degree of deceleration (1) and the start timing t0 (time t required for stopping (2)) which are determined based on the total length p of the sheet P and the distance a from the scraper roller 12*a* to the detecting position D where the sheet sensor 19 is installed. The degree of deceleration (1) and the time t required for stopping (2) are the time required for the deceleration control of stopping the paper feeding rollers 12 before the subsequent sheet P is sent.

Accordingly, the paper feeding motor 14 can be braked to stop before the timing t4 of stopping of the paper feeding rollers 12 (scraper roller 12*a* and pickup roller 12*b*) no longer rotated by the sheet P due to passing of the sheet P.

Thus, in the process of stopping the paper feeding motor 14 rotating the paper feeding rollers 12, it is possible to suppress the situation where the paper feeding motor 14 continues to rotate after the passing of the trailing edge Pe of the sent-out sheet P and where the paper feeding rollers 12 send out the subsequent sheet P in the paper feed tray 11 by the time the paper feeding motor 14 stops. This can suppress the position shift of the subsequent sheet P.

Note that, when it is apparent from the design that the value Q1 of the braking torque Q applied to the paper feeding motor 14 in the deceleration control falls within the allowable range regardless of the determined value of the degree of deceleration (1), the procedure of checking whether the value Q1 of the braking torque Q falls within the allowable range every time the degree of deceleration (1) is determined can be omitted. Moreover, it is possible to omit the configuration in which the inertia J of the paper feeding rollers 12 used to determine the degree of deceleration (1) is changed depending on the paper type of the sheet P, and determine the degree of deceleration (1) by using the same inertia J for any paper type of the sheet P.

Moreover, the controller 4 may predict whether the stop of the rotation of the paper feeding motor 14 by inertia is after the timing t4 at which the rotation of the paper feeding rollers 12 by inertia after the passing of the sheet P should stop. In this case, when the controller 4 predicts that the stop is after the timing t4, the controller 4 can determine the degree of deceleration (1) or determine the time t required for stopping (2) and the start timing t0 of the deceleration control based thereon, and perform the deceleration control of the paper feeding motor 14 according to the determined content.

The prediction by the controller 4 on whether the stop of the rotation of the paper feeding motor 14 by inertia is after the timing t4 can be performed by providing a rotary encoder in a rotating system from the paper feeding motor 14 to the paper feeding rollers 12 and using an output from the rotary encoder.

For example, the controller 4 samples the output of the rotary encoder at the timing t3 of the trailing edge of the sheet P passing the pickup roller 12*b* or at an appropriate timing close to the timing t3, and thereby obtains the rotational speed or the number of revolutions per unit time of the paper feeding rollers 12 (the rotational speed or the number of revolutions can be obtained for both or either one of the scraper roller 12*a* and the pickup roller 12*b*) at this timing.

Then, when the obtained rotational speed or the number of revolutions per unit time exceeds a reference value, the controller 4 determines that the rotational speed of the paper feeding motor 14 at the timing t3 of the trailing edge of the sheet P passing the pickup roller 12*b* is too fast, and predicts that the stop of the rotation of the paper feeding motor 14 by inertia is after the timing t4 at which the rotation of the paper feeding rollers 12 by inertia should stop.

Furthermore, although the case where the paper feeding rollers 12 include the scraper roller 12*a* and the pickup roller 12*b* is described in the aforementioned embodiment, the paper feeding roller 12 may include a single roller. Moreover, although the printer 1 is described as the inkjet printer in the aforementioned embodiment, the printer 1 is not limited to this. The printer may be a printer other than the inkjet printer such as an electrophotographic printer, a stencil printer, or a thermal printer, for example, as long as the paper feeding device included in the printer is a paper feeding device configured to feed the sheets stacked on the paper feed tray one by one.

Moreover, although description is given in the aforementioned embodiment by using the example in which the paper feeding device is integrally incorporated in the printer, the paper feeding device may be provided independent from the printer.

Furthermore, the paper feeding device can perform both of the aforementioned deceleration control of setting the degree of deceleration of the paper feeding motor 14 greater than the degree of deceleration due to inertia and the aforementioned control of making the start timing of the deceleration control earlier than the timing t1 of the sheet sensor 19 detecting the leading edge of the sheet P passing the intermediate conveying rollers 15.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A paper feeding device comprising:

a paper feeding roller configured to rotate at a predetermined speed and to feed sheets one by one from a paper feed tray on which the sheets are stacked to a sheet conveying route located downstream of the paper feed tray in a sheet conveying direction;

a paper feeding motor configured to perform a rotating operation of rotating the paper feeding roller and to maintain a rotational speed of the paper feeding roller at the predetermined speed;

an intermediate conveying roller arranged downstream of the paper feeding roller in the sheet conveying direction along the sheet conveying route and configured to feed each of the sheets fed by the paper feeding roller to a position located downstream of the intermediate conveying roller in the sheet conveying direction along the sheet conveying route;

a sheet sensor configured to detect a leading edge of the sheet reaching the intermediate conveying roller;

a printer arranged downstream of the intermediate conveying roller in the sheet conveying direction along the sheet conveying route and configured to perform printing on the sheet; and a controller, wherein the paper feeding roller and the sheet sensor are positioned between the paper feed tray and the printer along the sheet conveying route, and wherein the controller is configured to determine a content of braking control on the rotating operation such that rotation of the paper feeding motor stops within a time required for stopping from a time that the sheet is detected by the sheet sensor to a time that a trailing edge of the sheet passes the paper feeding roller, and such that the paper feeding roller is not rotated by the paper feeding motor when the trailing edge of the sheet passes the paper feeding roller, the time required for stopping being determined based on a length of the sheet in the sheet conveying direction, the predetermined speed, and a distance between the paper feeding roller and the sheet sensor along the sheet conveying route; and perform the braking control on the rotating operation of the paper feeding motor, according to the determined content, upon or prior to the detection, by the sheet sensor, of the sheet fed by the paper feeding roller.

2. The paper feeding device according to claim 1, wherein the controller determines that the content of the braking control includes a start timing of deceleration control on the rotating operation of the paper feeding motor at a degree of deceleration due to inertia.

3. The paper feeding device according to claim 2, wherein the controller determines the content of the braking control from inertia of the paper feeding roller, depending on a paper type of the sheet.

4. The paper feeding device according to claim 2, wherein the controller determines a time prior to the detection of the sheet by the sheet sensor as the start of the deceleration control.

5. The paper feeding device according to claim 2, wherein the controller determines that the content of the braking control includes deceleration control on the rotating operation of the paper feeding motor at a degree of deceleration and a start time of the deceleration control.

6. The paper feeding device according to claim 2, wherein only the rotation of the paper feeding motor in a direction in which the sheet is fed in the sheet conveying direction, is transmitted to the paper feeding roller from the paper feeding motor.

7. The paper feeding device according to claim 1, wherein the controller determines the content of the braking control from inertia of the paper feeding roller, depending on a paper type of the sheet.

8. The paper feeding device according to claim 1, wherein only the rotation of the paper feeding motor in a direction in which the sheet is fed in the sheet conveying direction, is transmitted to the paper feeding roller from the paper feeding motor.

9. A paper feeding device comprising:

a paper feeding roller configured to rotate at a predetermined speed and to feed sheets one by one from a paper feed tray on which the sheets are stacked to a sheet conveying route located downstream of the paper feed tray in a sheet conveying direction;

a paper feeding motor configured to perform a rotating operation of rotating the paper feeding roller and to maintain a rotational speed of the paper feeding roller at the predetermined speed;

an intermediate conveying roller arranged downstream of the paper feeding roller in the sheet conveying direction along the sheet conveying route and configured to feed each of the sheets fed by the paper feeding roller to a position located downstream of the intermediate conveying roller in the sheet conveying direction along the sheet conveying route;

a sheet sensor configured to detect a leading edge of the sheet reaching the intermediate conveying roller; and a controller, wherein the controller is configured to determine a content of braking control on the rotating operation such that rotation of the paper feeding motor stops within a time required for stopping, from a time that of the sheet is detected by the sheet sensor to a time that a trailing edge of the sheet passes the paper feeding roller, the time required for stopping being determined based on a length of the sheet in the sheet conveying direction, the predetermined speed, and a distance between the paper feeding roller and the sheet sensor along the sheet conveying route, perform the braking control on the rotating operation of the paper feeding motor, according to the determined content, upon or prior to the detection, by the sheet sensor, of the sheet fed by the paper feeding roller, and determine deceleration control on the rotating operation of the paper feeding motor at a degree of deceleration as the content of the braking control.

10. The paper feeding device according to claim 9, wherein the controller determines the content of the braking control from inertia of the paper feeding roller, depending on a paper type of the sheet.

11. The paper feeding device according to claim 9, wherein the controller determines a detection time of the sheet by the sheet sensor as a start of the deceleration control.

12. The paper feeding device according to claim 9, wherein the controller determines that the content of the braking control includes deceleration control on the rotating operation of the paper feeding motor at a degree of deceleration and a start time of the deceleration control.

13. The paper feeding device according to claim 9, wherein only the rotation of the paper feeding motor in a direction in which the sheet is fed in the sheet conveying direction, is transmitted to the paper feeding roller from the paper feeding motor.

14. A paper feeding device comprising:

a paper feeding roller configured to rotate at a predetermined speed and to feed sheets one by one from a paper feed tray on which the sheets are stacked to a sheet conveying route located downstream of the paper feed tray in a sheet conveying direction;

a paper feeding motor configured to perform a rotating operation of rotating the paper feeding roller and to maintain a rotational speed of the paper feeding roller at the predetermined speed;

an intermediate conveying roller arranged downstream of the paper feeding roller in the sheet conveying direction along the sheet conveying route and configured to feed each of the sheets fed by the paper feeding roller to a position located downstream of the intermediate conveying roller in the sheet conveying direction along the sheet conveying route;

a sheet sensor configured to detect a leading edge of the sheet reaching the intermediate conveying roller; and a controller, wherein the controller is configured to determine a content of braking control on the rotating operation such that rotation of the paper feeding motor stops within a time required for stopping from a time that the sheet is detected by the sheet sensor to a time that a trailing edge of the sheet passes the paper feeding roller, the time required for stopping being determined based on a length of the sheet in the sheet conveying direction, the predetermined speed, and a distance between the paper feeding roller and the sheet sensor along the sheet conveying route, perform the braking control on the rotating operation of the paper feeding motor, according to the determined content, upon or prior to the detection, by the sheet sensor, of the sheet fed by the paper feeding roller, and determine that the content of the braking control includes deceleration control on the rotating operation of the paper feeding motor at a degree of deceleration and a start time of the deceleration control.

15. The paper feeding device according to claim 14, wherein only the rotation of the paper feeding motor in a direction in which the sheet is fed in the sheet conveying direction, is transmitted to the paper feeding roller from the paper feeding motor.

* * * * *